US005829461A

United States Patent [19]

Ramsey

[11] Patent Number: 5,829,461

[45] Date of Patent: Nov. 3, 1998

[54] INTERIOR TANK CLEANING APPARATUS

[76] Inventor: Donald Ramsey, 962 Cornell Ave., Youngstown, Ohio 44502

[21] Appl. No.: 781,215

[22] Filed: Jan. 10, 1997

[51] Int. Cl.[6] ..... B08B 3/02; B08B 9/12

[52] U.S. Cl. ..... 134/167 R

[58] Field of Search ..... 134/167 R, 167 C, 134/168 R, 168 C; 118/306

[56] References Cited

U.S. PATENT DOCUMENTS

| | | | |
|---|---|---|---|
| 2,017,042 | 10/1935 | Dougherty | 134/167 C X |
| 3,071,107 | 1/1963 | Stanley | 118/306 |
| 3,106,491 | 10/1963 | Leibner | 118/306 X |
| 3,449,783 | 6/1969 | Kirschke | 15/104.12 |
| 3,994,310 | 11/1976 | Brandon | 134/167 C |
| 4,206,313 | 6/1980 | Cavoretto | 134/167 C |
| 4,559,960 | 12/1985 | Lanier | 134/167 C X |
| 4,690,159 | 9/1987 | Vadakin et al. | 134/167 C |
| 5,113,885 | 5/1992 | Ramsey | 134/167 C |
| 5,444,887 | 8/1995 | Rufolo | 15/104.31 |

FOREIGN PATENT DOCUMENTS

| | | | |
|---|---|---|---|
| 244158 | 10/1969 | U.S.S.R. | 118/306 |
| 602234 | 4/1978 | U.S.S.R. | 118/306 |
| 749458 | 7/1980 | U.S.S.R. | 134/167 C |

*Primary Examiner*—Philip R. Coe
*Attorney, Agent, or Firm*—Harpman & Harpman

[57] ABSTRACT

An apparatus for cleaning the interior of tanks or the like. The apparatus has high pressure rotary fluid distribution nozzles on rotating arms carried on a movable platform. The apparatus is self-centering within the enclosure with high pressure fluid swivels and quick disconnect air and fluid supply fittings associated therewith.

9 Claims, 7 Drawing Sheets

INTERIOR TANK CLEANING APPARATUS

BACKGROUND OF THE INVENTION

1. Technical Field

This device relates to tanks and pipe cleaning devices that travel through the interior of a tank or pipeline cleaning the interior surface as they go. These types of devices use mechanical and/or fluid under high pressure to scour the interior surface of debris and are usually pulled through the interior by auxiliary means.

2. Description of Prior Art

Prior art devices of this type have relied on a variety of structures having multiple cleaning heads on guide and support structures that position the cleaning heads in contact with the surface to be cleaned. See for example U.S. Pat. Nos. 3,449,783, 3,994,310, 4,206,313, 4,559,960, 5,113,885 and 5,444,887.

In U.S. Pat. No. 3,449,783 a hydraulic waste disposal line cleaner is disclosed having a high pressure source of fluid 600 to 1,000 PSI with jet propulsion means that drives the tool forward into the waste disposal line utilizing cleaning pressure fluid.

U.S. Pat. No. 3,994,310 is directed to a duct cleaning apparatus having a pair of fluid nozzles rotatably positioned on a support and supply arm with guide strips extending therefrom.

U.S. Pat. No. 4,206,313 on a pipe cleaning nozzle having multiple skids to space a nozzle body within a pipe. High pressure fluid is discharged propelling the nozzle through the pipe.

A sewer cleaning apparatus is disclosed in U.S. Pat. No. 4,559,960 wherein a wheeled carriage is pulled through the sewer line with a scraping disk mechanically engaging the interior walls as it goes.

Applicant's own U.S. Pat. No. 5,113,885 discloses a pipe cleaning apparatus wherein a support platform carries and positions a rotating centrally positioned spray nozzle as the assembly is pulled through the pipe.

U.S. Pat. No. 5,444,887 discloses an underwater pipe cleaning device having scrapper blades carried by a support frame that is pulled through the pipe.

SUMMARY OF THE INVENTION

A cleaning device for tanks and pipes to remove deposits and worn coatings from the interior surface thereof. The cleaning device uses ultra high pressure water dispensed from multiple nozzled heads on rotating extension arms supported by a positioning assembly engaging on the interior surface to be cleaned.

DESCRIPTION OF THE PREFERRED EMBODIMENT

Figure 1:
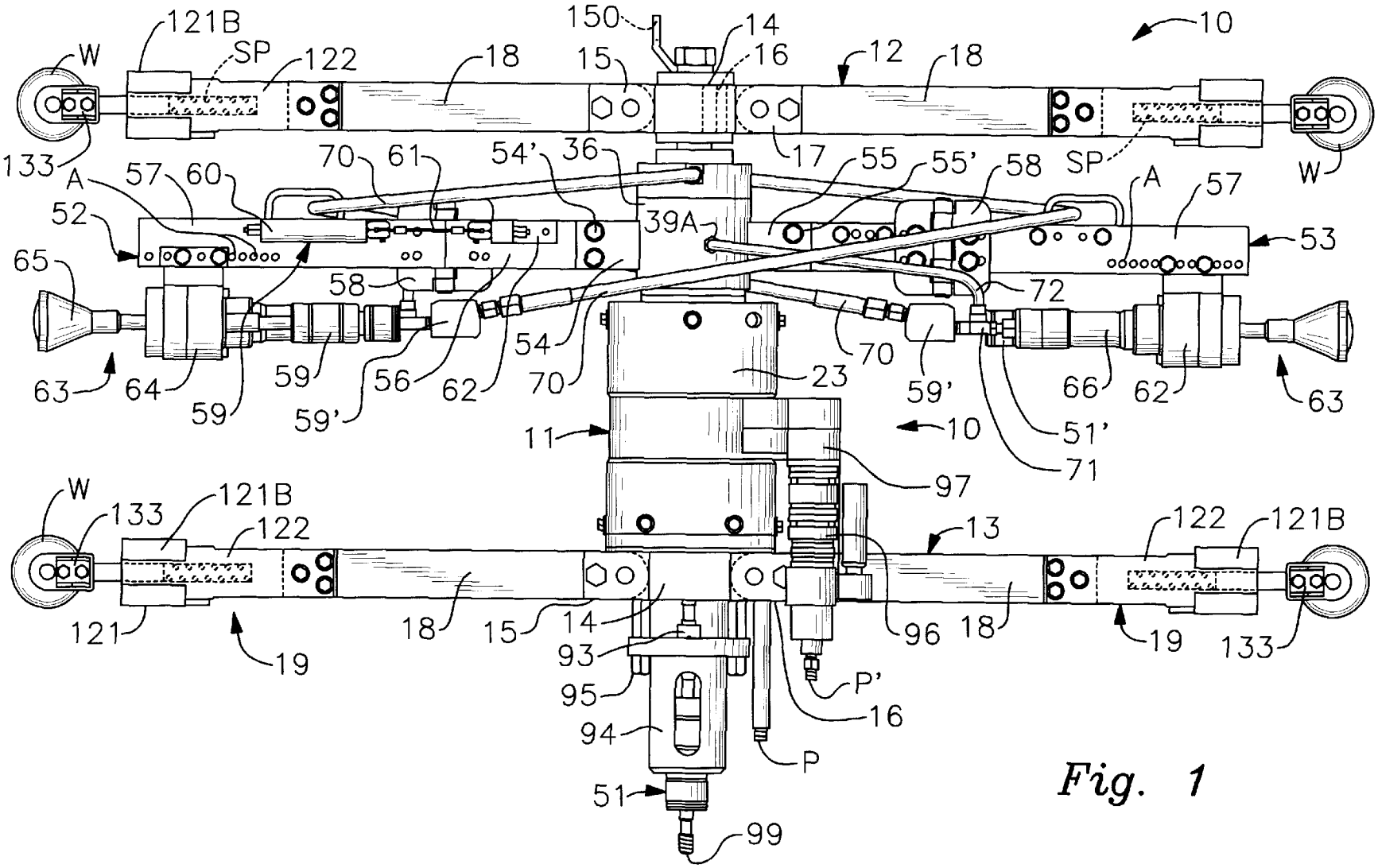
FIG. 1 is a top plan view of the cleaning device of the invention.
Figure 2:
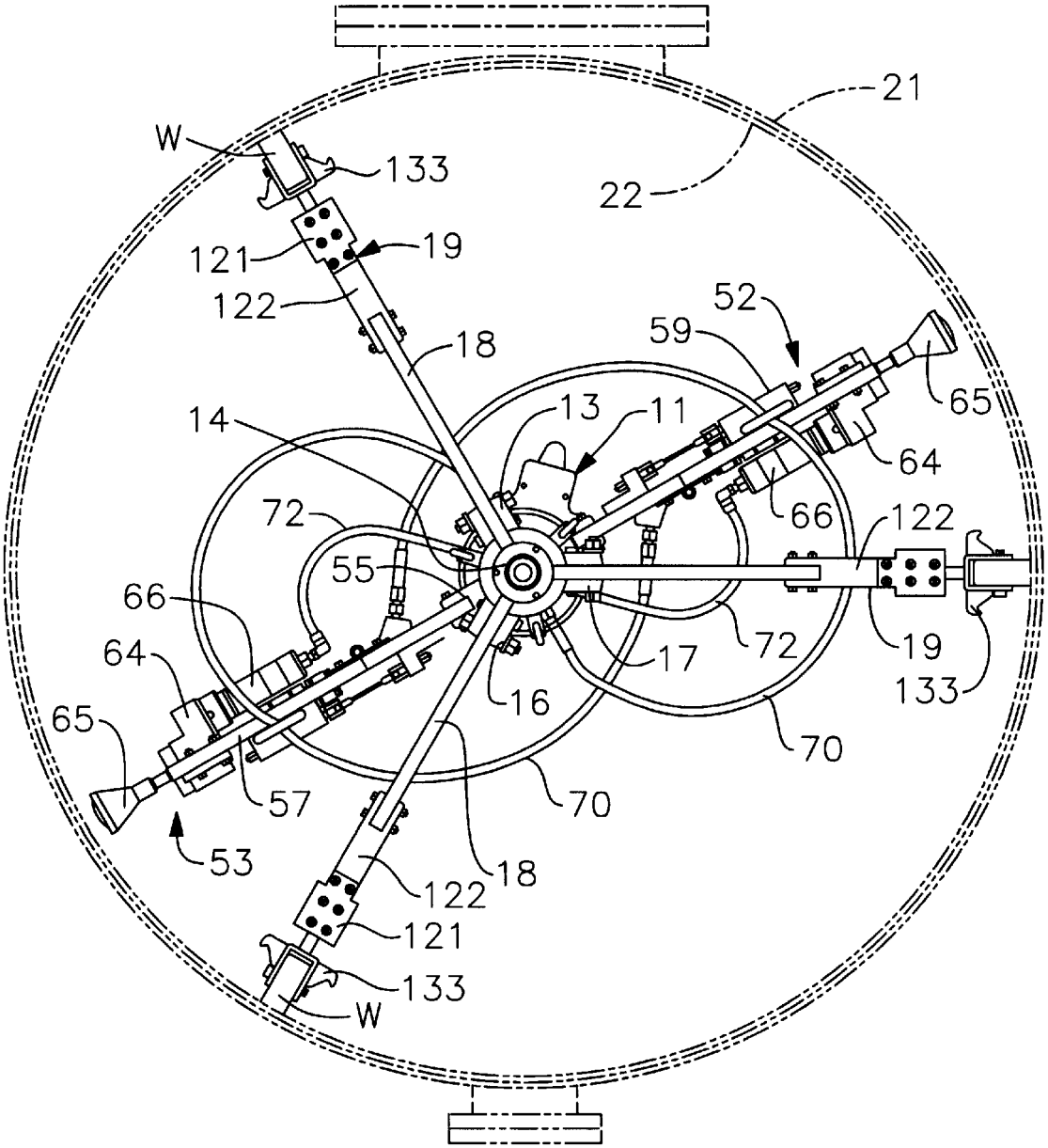
FIG. 2 is an end elevational view of the cleaning device of the invention illustrated in a tank shown in broken lines.
Figure 3A:
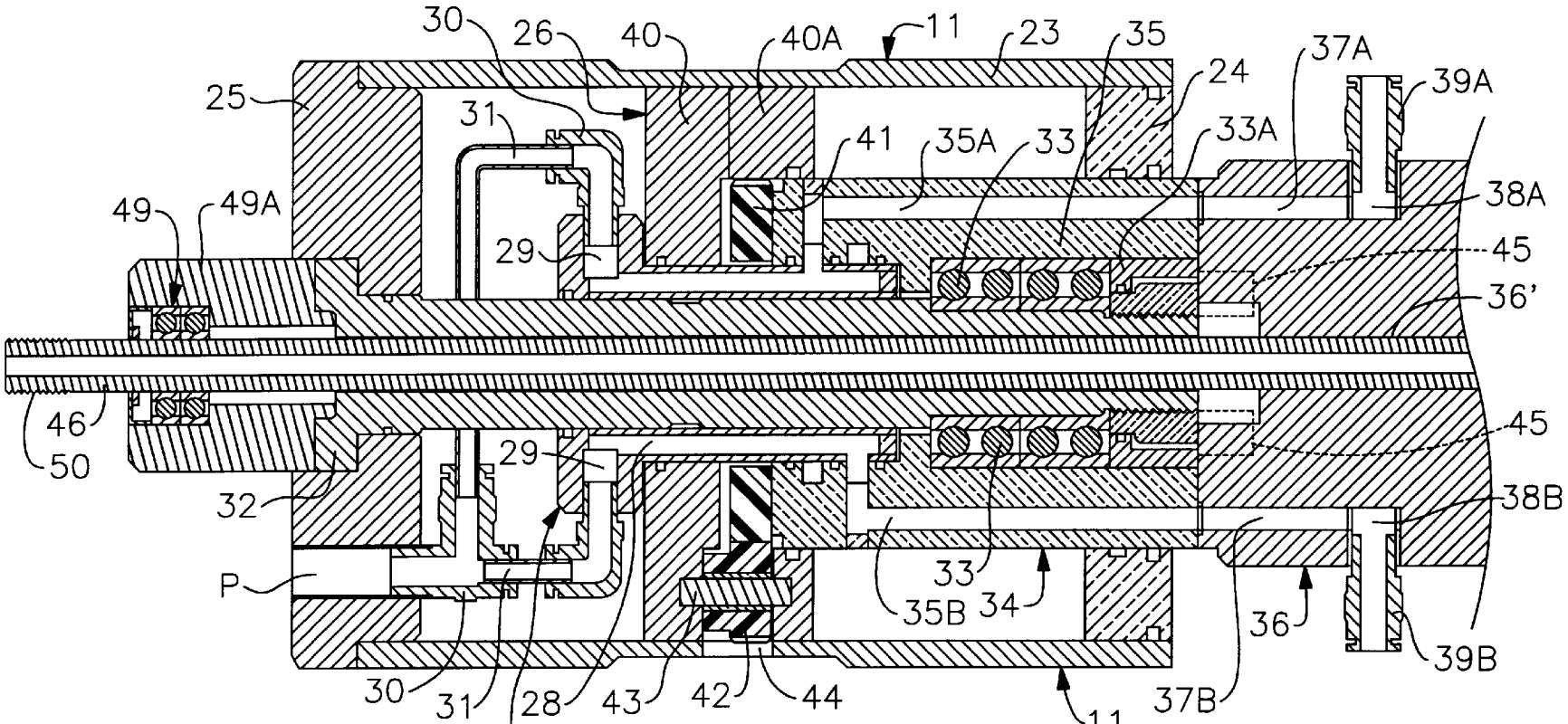
FIG. 3A is a cross-sectional view of the cleaning device of the invention with portions broken away.

Referring to FIGS. 1–3 of the drawings, a tank cleaning device 10 can be seen having a main support body member 11 with a pair of oppositely disposed leg assemblies 12 and 13 extending therefrom. Each of the leg assemblies has a support hub 14 secured to the main support body member 11. The hub 14 has multiple pairs of spaced upstanding apertured lugs 15, 16 and 17 from which extends respective leg bars 18. Each of the leg bars 18 has adjustable self-centering spring-loaded wheel assemblies 19 secured to their free ends by multiple fasteners as will be well understood by those skilled in the art. The leg assemblies 12 and 13 self-center within a cylindrical tank 21 having an interior surface 22 shown in broken lines in FIG. 2 of the drawings. It will be apparent that as the spring-loaded wheel assemblies 19 correspondingly engage the inner interior surface 22 of the cylindrical tank 21, the main support body member 11 is thus "centered" within as best seen in FIG. 2 of the drawings.

Referring now to FIGS. 1–3A of the drawings, the main support body member 11 has a cylindrical housing 23 with front bushing 24 and oppositely disposed apertured end cap 25 with an apertured center support fitting 26 therebetween. An air swivel fitting assembly 27 is positioned within the central fitting 26 having an annular air passage 28 with multiple air inlet ports 29 therein. An air supply fitting 30 with associated interconnected piping 31 extends from the apertured end cap 25 to the air inlet ports 29. An apertured central shaft 32 is registerably positioned through the respective end cap 25 and air swivel fitting assembly 27 hereinbefore described. A pair of bearing assemblies 33 are positioned on the central shaft 32 by a bearing retainer 33A and a shaft nut 33B threadably disposed thereon. The bearing assemblies 33 rotatably position a spray arm support hub assembly 34 thereon having a bearing engagement portion 35 within the cylinder housing 23.

The spray arm support hub assembly 34 has longitudinally extending air channels 35A and 35B and a spray arm engagement portion 36 extending outwardly from the cylindrical housing 23. The spray arm engagement portion 36 has longitudinally extending air channels 37A and B therein that are in communication with the air channels 35A and B, respectively; with outlet ports and connector fittings 38A and 38B and 39A and 39B respectively.

The central support fitting 26 forms the lower half of a head gear drive box enclosure 40 with an upper half 40A defining the gear box enclosure 40 having a main drive gear head 41 within the control fitting 26. An idler gear 42 on the shaft 43 engages the main drive gear 41 and is accessible by an opening at 44 in the main support body member 11 as will be explained in greater detail hereinafter.

Figure 4:
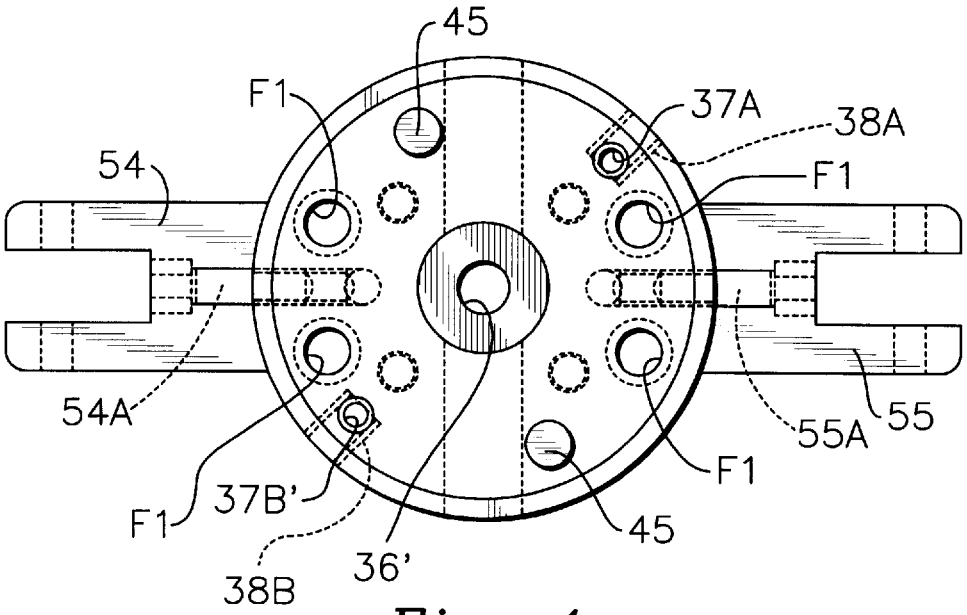
FIG. 4 is a top plan view of the invention.
Figure 5:
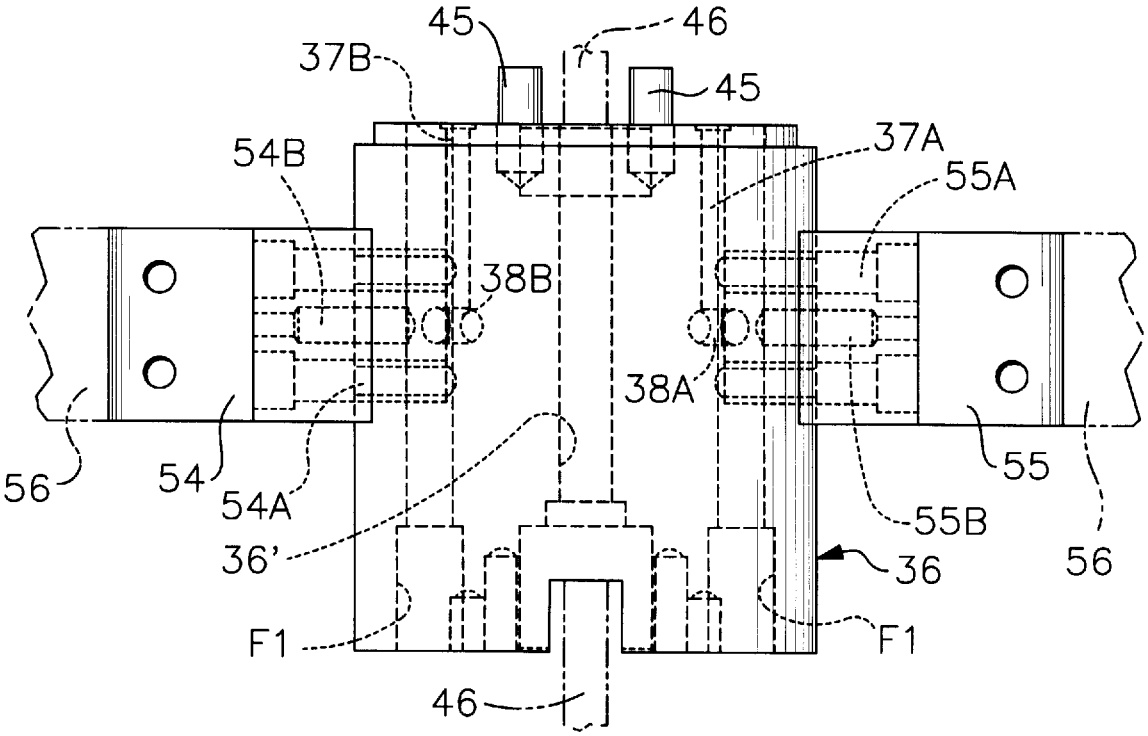
FIG. 5 is a side elevational view of the cleaning arm mounting portion of the cleaning device of the invention.

The spray arm engagement portion 36 having a central bore 36' therethrough is aligned for engagement and secured to the bearing engagement portion 35 by interconnecting pins 45 and fasteners F extending through registering openings F1 therein, best seen in FIGS. 4 & 5 of the drawings. A high pressure fluid feed pipe 46 is rotatably positioned through the central bore 36' of the center shaft 32 and has T-shaped outlet ends at 47A and 47B with respective high pressure fluid couplings 48 thereon. A pipe support bearing assembly 49 is positioned in a pipe and rear leg support fitting 49A extending from the end of the central shaft 32. The free end of the fluid feed pipe 46 is externally threaded at 50 to registerably receive a fluid swivel assembly 51, best seen in FIGS. 1 and 6 of the drawings which will be described in greater detail hereinafter.

Figure 3B:
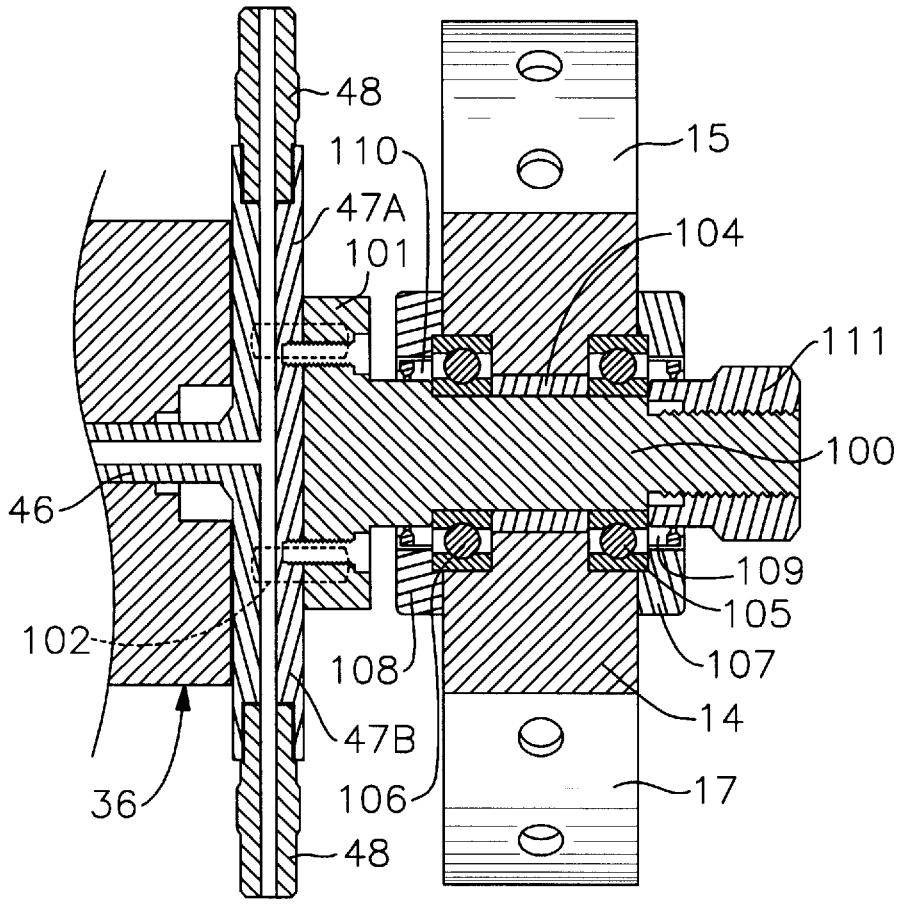
FIG. 3B is a cross-sectional view of the cleaning device of the invention with portions broken away.

Referring to FIG. 3B of the drawings, a more detailed view of the leg assembly 12 can be seen wherein the support hub 14 is positioned on the spray arm engagement portion 36 of the main support body by a leg support shaft 100 having an apertured annular base 101 with a plurality of fasteners extending therethrough, with alignment pins 102 extending therebetween shown in dotted lines. Bearing assemblies 105 & 106 within the hub 14 allow for rotation on the leg support shaft 100. The bearing assemblies 105 & 106 have a bearing spacer 104 therebetween with respective bearing caps 107, 108 and seals 109 and 110. A retaining nut 111 threadably engages the free end of the leg support shaft as will be understood by those skilled in the art.

Referring back to FIGS. 1, 2, 4 and 5 of the drawings, cleaning arm assemblies 52 and 53 can be seen removably secured to a pair of apertured bifurcated mounting brackets 54 and 55 by multiple fasteners 54' and 55' respectively that are in oppositely disposed relation to one another extending from the spray arm engagement portion 36. The mounting brackets 54 & 55 are aligned and secured to the spray arm engagement portion 36 by multiple fasteners 54A and 55A and pins 54A and 55B respectively, best seen in FIG. 5 of the drawings. Each of the cleaning arm assemblies 52 and 53 have first and second support bars 56 and 57 hinged together by hinge 58 and have multiple longitudinally aligned apertures in the second support bars 57.

A spray arm tensioning assembly 59 extends longitudinally between the support bars 56 and 57. The tensioning assembly 59 has a spring housing fitting 60 on the second support bar 57 from which a spring-urged cable 61 extends therefrom (as will be well understood by those skilled in the art) to an engagement fitting 62 on the first support bar opposite said hinge side of the bars maintaining the respective support bars 56 and 57 in an extended open relationship. A nozzle assembly 63 is adjustably positioned on the free ends of the respective cleaning arm assemblies 52 and 53, best seen in FIGS. 1 and 2 of the drawings.

Each of the nozzle assemblies 63 are positioned on a drive and support bracket fitting 64 and has a multiple outlet rotatable spray head 65 connected to a second high pressure fluid swivel 51' and a source of fluid under high pressure.

Air motors 66 are positioned on the respective support brackets 64 adjacent said respective high pressure fluid swivel 51' and are in geared connection with the respective nozzle assemblies 63 by a pair of inner meshing gears (not shown) as will be well understood by those skilled in the art.

Fluid couplings 59' and flexible fluid supply lines 70 interconnect the fluid swivels 51' with the hereinbefore described high pressure spray heads 65.

Air fittings 71 and flexible air supply lines 72 interconnect the air couplings 39A and B with the air motors 66 on the spray arm assemblies 52 and 53.

Figure 6:
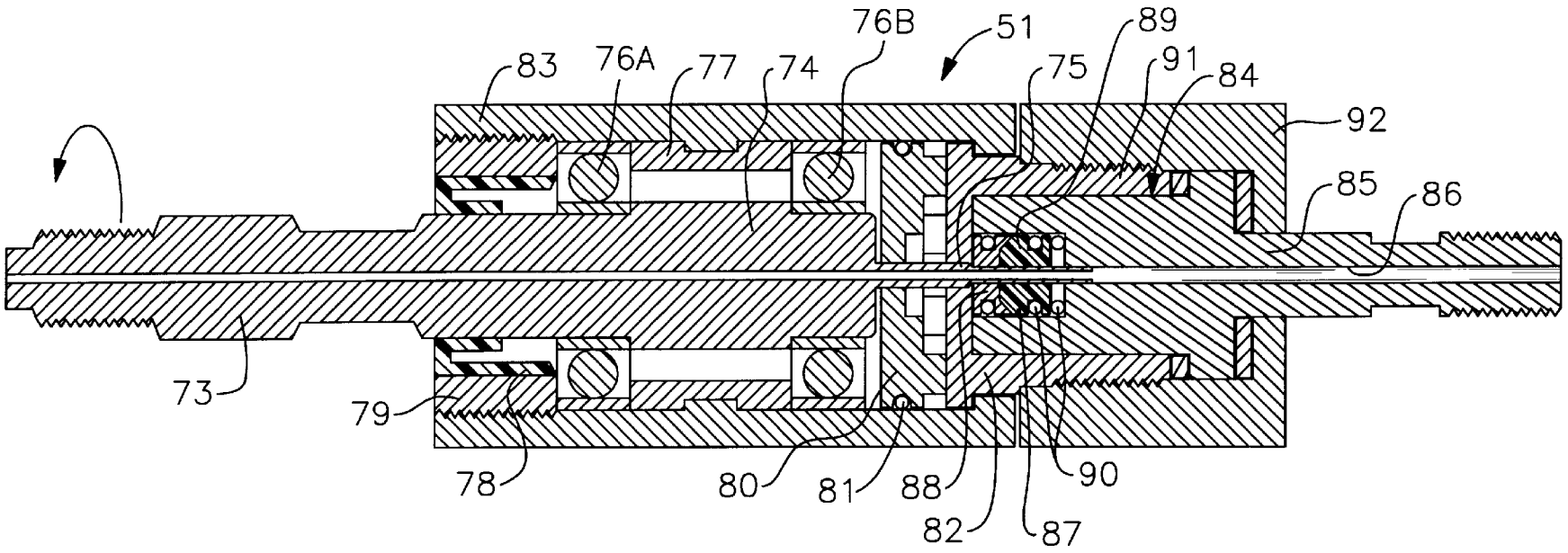
FIG. 6 is an enlarged cross-sectional view of a high pressure fluid swivel.

Referring now to FIG. 6 of the drawings the fluid swivel assembly 51 can be seen having a main shaft 73 having an area of increased diameter at 74 and of reduced diameter at 75. A pair of bearings 76A and 76B are positioned on the shaft 73 adjacent the area of increased diameter at 74 with a split bearing spacer 77 therebetween. A lock nut gear seal 78 and bearing lock nut 79 are positioned on the main shaft 73 abutting said bearing 76A. A weep plate 80 with a weep plate seal 81 is positioned on the shaft's area of reduced diameter at 75 adjacent the bearing 76B with a seal holder housing 82. The shaft 73 and related assemblies are slideably positioned within a swivel housing 83 being threadably secured thereto by the lock nut 79 positioned thereon. A high pressure seal assembly 84 is registerable within the seal holder housing 82 on the shaft 73 area of reduced diameter at 75. The high pressure sealing assembly 84 has a seal body 85 with a central bore 86 therethrough and a seal receiving bore area 87 with a seal bushing 88, nylon seal element 89 and O-rings 90 therein. The seal holder housing 82 has an externally threaded portion 91 with a retaining nut 92 threadably disposed thereon.

Referring to FIG. 1 of the drawings, the fluid swivel 51 is interconnected to the inlet end of the fluid feed pipe 46 by a coupling 93 and is positioned in a support bracket 94 extending from a rear leg mounting assembly 95 extends from the hub 14 hereinbefore described.

In operation, to remove and/or disconnect the identical high pressure fluid swivel assemblies 51 and 51', the retaining nut 92 (having left hand threads) is removed by hand, thus removing the sealing assembly 84 therefrom as will be well understood by those skilled in the art.

Referring back to FIG. 1 of the drawings, the tank cleaning device 10 of the invention is shown having a main air drive motor 96 and drive gear assembly housing 97 mounted on the cylindrical housing 23 so as to be registerable with the idler gear 42 through the opening 44 in the main support body so as to rotate the spray arm support hub assembly and spray arm engagement portion 36 interconnected thereto as hereinbefore described.

Figure 7:
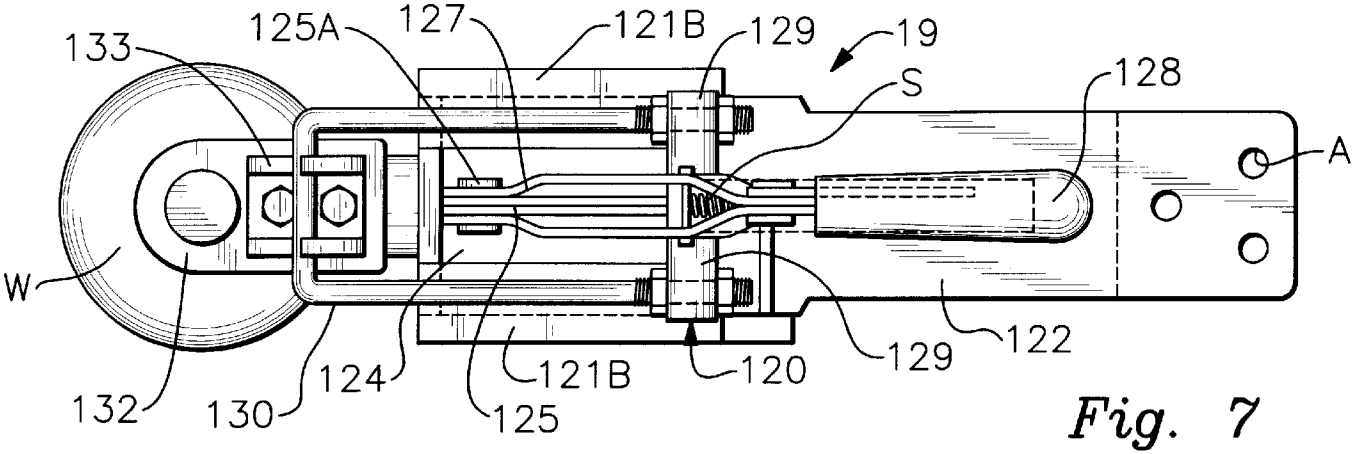
FIG. 7 is an enlarged top plan view of an end portion of a support leg with a wheel assembly retracting clamp.
Figure 8:
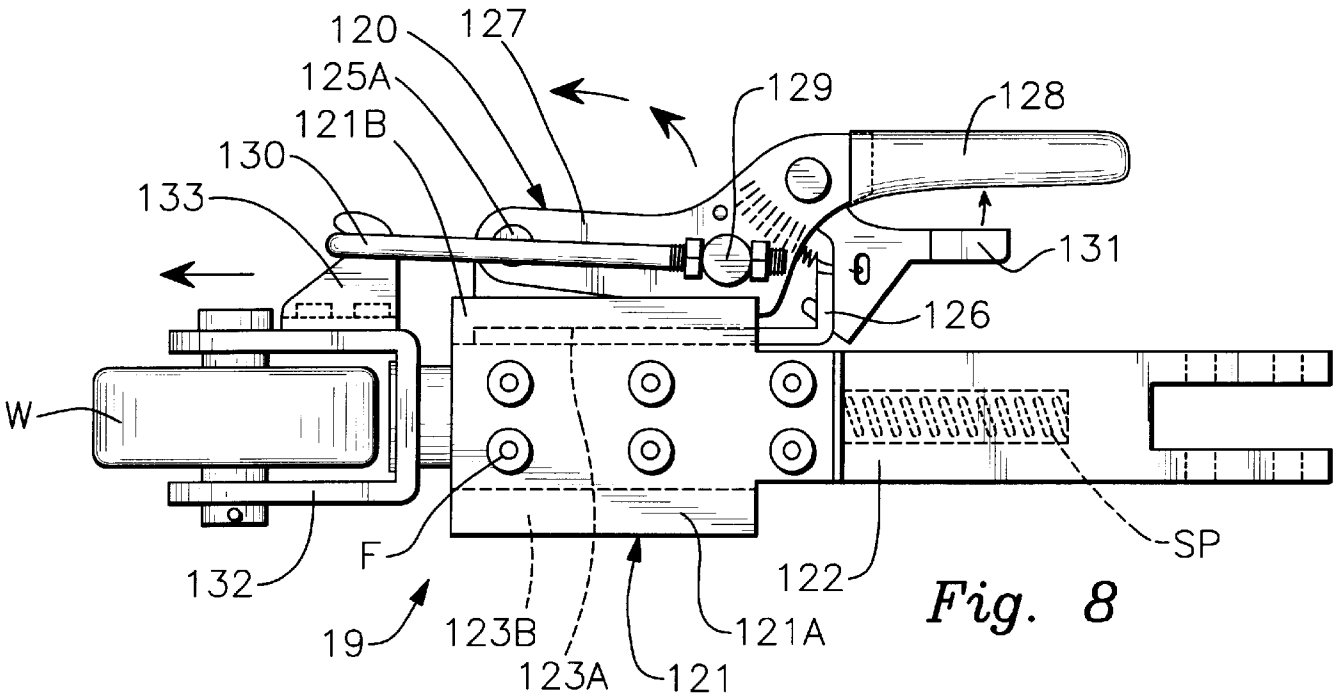
FIG. 8 is an enlarged side elevational view of the wheel assembly retracting clamp of FIG. 7.

Referring now to FIGS. 7 and 8 of the drawings, the self-centering spring loaded wheel assemblies 19 are shown each having a wheel retraction clamp 120 thereon. The retraction clamp 120 is slideably positioned between a pair of mounting brackets 121 that are secured to the ends of a wheel leg assembly 122 on each of said legs 18. The mounting brackets 121 have oppositely disposed elongated flanges 121A and 121B that overlie in spaced relation respective portions of the leg assemblies 122 defining multiple engagement slots 123A and 123B respectively therebetween. Each of the retraction clamps 120 has a bifurcated base 124 with an upstanding apertured lug 125 extending therefrom and an engagement arm 126. A handle bracket 127 is pivotally secured to the lug 125 by pivot pin 125A and has an offset handle portion 128. A mounting rod 129 is pivotally positioned through aligned apertures in the handle bracket 127 with a U-shaped bar 130 extending therefrom.

A spring-urged release lever 131 pivotally extends from the handle portion 128 and is selectively registerable on the engagement arm 126 as best seen in FIG. 8 of the drawings.

Each of the wheel assemblies 19 has a bifurcated mounting bracket 132 holding the wheel W and having an upstanding retainer hooks 133 extending therefrom.

In operation, the U-shaped rod 130 is engaged over the retaining hooks 133 by pivoting the clamp assembly about the pivot pin 125A as indicated by directional arrows in FIG. 8 of the drawings and then by arcuate movement of the handle in the reverse direction towards the leg assembly effectively retracting the wheel into the end of the leg assembly 122 by pressing a wheel assembly support rod R against the spring SP compressing same.

Upon full retraction, the spring-urged (S) release lever 131 engages the retaining arm 126 locking the clamp in compressed restrained position as illustrated in FIGS. 7 and 8.

To deploy the tank cleaning device 10 of the invention within the tank 21, the respective support leg assemblies 12 and 13 are removed and/or pivoted downwardly along the main body member and the spray arm assemblies 52 and 53 with respective assembly supply lines are disconnected, if required, for insertion into the tank.

Once inserted within the tank 21, the respective leg assemblies 12 and 13 are deployed and the spring-loaded wheel fittings 19 on the respective ends are released by opening the retraction clamps 120 which are positioned on each of said respective wheel fitting 19, best seen in FIGS. 7 and 8 so as to engage the interior surface 22 of the tank 21 thus stabilizing and centering the cleaning device 10 of the invention within the tank.

The spray arms are re-attached and adjustably positioned so as to present the rotatable spray head 65 at the desired cleaning distance from the interior surface 22 of the tank 21.

A source of cleaning fluid (water) under high pressure for cleaning purposes (not shown) is connected to an inlet 99 of the high pressure fluid swivel 51 providing fluid through the fluid supply pipe 46 and the respective oppositely disposed high pressure couplings 48 which are in turn interconnected by respective high pressure fluid lines 70 and couplings to the fluid swivels 51' on the spray nozzle assemblies on the respective support arms.

A source of air pressure (not shown) is connected to the inlet port (P) of the high pressure air fittings 30 and thus supplies the air swivel 27 with air pressure within the annular aperture at 28 and to the respective air channels 35A and 35B to the respective outlet ports 37 and 38 which in turn supplies the outlet ports 38A and 38B and respective quick release couplings 39A and 39B.

Interconnecting air lines 72 extend from the respective couplings 39A and B to the air motors 66 on the respective cleaning arms supply air lines (not shown) provide air under pressure to the air drive motor 94 via air inlet port P'.

The cleaning device 10 of the invention is manually pulled through the tank by an outside conveyance (not shown) connected to an engagement lug 150 on the front hub 14 thereof.

Thus it will be seen that a new and novel tank cleaning device has been illustrated and described and it will be apparent to those skilled in the art that various changes and modifications may be made therein without departing from the spirit of the invention.

Therefore I claim:

1. An apparatus for cleaning the interior surface of a tank comprising; a main support body having a front bushing and an oppositely disposed aperture end cap therein, multiple leg assemblies extending from said support body, for engagement with said tank's interior surface, a central shaft within said main support body, a support hub rotatably positioned on said central shaft in said front bushing, cleaning arms positioned on said support hub, spray nozzle assemblies on said respective cleaning arms for cleaning the interior surface of the tank, air supply channels in said support hub, an air supply swivel fitting rotatably positioned on said central shaft, an annular air supply passageway in said air supply swivel fitting having inlet and outlet ports in communication with a source of air under pressure and said annular air passageways respectively for rotation of said cleaning arms about said central shaft, a fluid supply pipe rotatable positioned through said central support shaft, means for rotating said support hub and means for rotatably connecting said fluid supply pipe to a source of fluid under pressure and to said spray nozzle assemblies.

2. The apparatus as set forth in claim 1 wherein said multiple leg assemblies comprise; mounting hubs, apertured legs extending from said hubs, leg bars extending from said legs, resilient wheel assemblies on the free ends of said respective leg bars and means for adjustably positioning said wheel assemblies thereto to center said main support body within the interior of said tank.

3. The apparatus set forth in claim 1 wherein said spray nozzle assembly for cleaning the interior surface of said tank comprises; a drive and support bracket adjustably positioned on said cleaning arm, a rotatable spray head on said drive and support bracket, means for rotating said spray head and means for interconnecting said spray head with said fluid supply pipe, and means for rotating said spray head.

4. The apparatus as set forth in claim 3 wherein said means for rotating said spray heads comprises; an air motor and gear assembly on said respective support arms and a source of air under pressure for said air motor.

5. The apparatus set forth in claim 1 wherein said means for rotatably connecting said fluid supply pipe to a source of fluid and said spray nozzles comprises; a fluid swivel.

6. The apparatus set forth in claim 5 wherein said fluid swivel for supplying fluid under pressure to said spray nozzle assemblies comprises; a housing, fluid supply shaft within said housing, a central bore through said shaft, bearing assemblies on said supply shaft, a seal holder extending from said housing, a sealing body registerable in said sealing holder having a central bore therein, multiple sealing elements within said sealing body registerable on a portion of said supply shaft and means for threadably securing said sealing body to said housing.

7. The apparatus set forth in claim 1 wherein said means for rotating said support hub comprises; a drive gear on said hub, an air motor engaged on said drive gear and a source of air under pressure for said air motor.

8. The apparatus set forth in claim 1 wherein said cleaning arms comprise; a first support bar secured to said hub, a second support bar pivotally secured to said first support bar, tension means between said first and second support bars.

9. The apparatus set forth in claim 6 wherein said tension means comprises; a spring secured to said second support bar, a tension cable extending from said spring to said first support bar.

* * * * *